US006416623B1

(12) United States Patent
Hollmark et al.

(10) Patent No.: US 6,416,623 B1
(45) Date of Patent: Jul. 9, 2002

(54) METHOD OF PRODUCING AN EXTENSIBLE PAPER HAVING A THREE-DIMENSIONAL PATTERN AND A PAPER PRODUCED BY THE METHOD

(75) Inventors: Holger Hollmark, Stockholm; Lennart Reiner, Karlstad; Hans Wallenius, Ljungskile; Thomas Billgren, Kullavik; Ingvar Klerelid, Karlstad, all of (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 09/822,383

(22) Filed: Apr. 2, 2001

Related U.S. Application Data

(63) Continuation of application No. PCT/SE99/01725, filed on Sep. 29, 1999.

(30) Foreign Application Priority Data

Oct. 1, 1998 (SE) ..... 9803362
Jun. 30, 1999 (SE) ..... 9902505

(51) Int. Cl.[7] ..... D21F 11/00; D21F 3/02
(52) U.S. Cl. ..... 162/109; 162/111; 162/206
(58) Field of Search ..... 162/109, 111, 162/113, 116, 117, 205–206, 361–362, 358.5; 34/397–400, 419, 423, 424–426, 442, 446

(56) References Cited

U.S. PATENT DOCUMENTS 4,324,613 A * 4/1982 Wahren ..... 162/111
5,126,015 A * 6/1992 Pounder ..... 162/206
5,404,654 A * 4/1995 Babinsky et al. ..... 34/122
5,439,559 A * 8/1995 Crouse ..... 162/358.5
5,598,642 A * 2/1997 Orloff et al. ..... 34/388
5,607,551 A * 3/1997 Farrington, Jr. et al. .... 162/109
5,672,248 A * 9/1997 Wendt et al. ..... 162/109
5,830,321 A * 11/1998 Lindsay et al. ..... 162/204
6,049,998 A * 4/2000 Crouse et al. ..... 34/445
6,146,499 A * 11/2000 Lin et al. ..... 162/197
6,223,450 B1 * 5/2001 Banerjee ..... 34/116
6,309,512 B1 * 10/2001 Bengtsson et al. ..... 162/358.5

FOREIGN PATENT DOCUMENTS

EP 0 490 655 6/1992

* cited by examiner

*Primary Examiner*—Jose Fortuna
(74) *Attorney, Agent, or Firm*—Young & Thompson

(57) ABSTRACT

Method of producing a paper having a three-dimensional pattern of alternating raised and recessed portions, which has been provided in connection with impulse drying, at which the wet paper web (10) is passed through at least one press nip (12) comprising a rotatable roll (13) which is heated and that the paper web during the passage through the press nip is given a three-dimensional pattern of alternating raised and recessed portions either by means of a patterned wire, band or belt and/or by a pattern on the heated roll (13) and where said pattern is pressed into the paper web against a counter means (11, 14). The wet paper web before said press nip is exerted to a creping- or other compacting procedure which foreshortens the length of the paper web. The invention also refers to a paper produced by the method, said paper having a high extensibility.

7 Claims, 1 Drawing Sheet

METHOD OF PRODUCING AN EXTENSIBLE PAPER HAVING A THREE-DIMENSIONAL PATTERN AND A PAPER PRODUCED BY THE METHOD

This is a continuation of co-pending international application No. PCT/SE99/01725 filed on Sep. 29, 1999, which designated the United States of America.

TECHNICAL FIELD

The present invention refers to a method of producing a paper having a three dimensional pattern of alternating raised and recessed portions, which has been provided in connection with impulse drying, at which the wet paper web is passed through at least one press nip comprising a rotatable roll which is heated and that the paper web during the passage through the press nip is given a three dimensional pattern of alternating raised and recessed portions either by means of a patterned wire, band or belt and/or by a pattern on the heated roll and where said pattern is pressed into the paper web against a counter means.

BACKGROUND OF THE INVENTION

Moist paper webs are usually dried against one or more heated rolls. A method which is commonly used for tissue paper is so called Yankee drying. At Yankee drying the moist paper web is pressed against a steam-heated Yankee cylinder, which can have a very large diameter. Further heat for drying is supplied by blowing of heated air. If the paper to be produced is soft paper the paper web is usually creped against the Yankee cylinder. The drying against the Yankee cylinder is preceded by a vacuum dewatering and a wet pressing, in which the water is mechanically pressed out of the paper web.

Another drying method is so called through-air-drying (TAD). In this method the paper is dried by means of hot air which is blown through the moist paper web, often without a preceding wet pressing. The paper web which enters the through-air-dryer is then only vacuum dewatered and has a dry content of about 25–30% and is dried in the through-air-dryer to a dry content of about 25–95%. The paper web is transferred to a special drying fabric and is passed over a so called TAD cylinder having an open structure. Hot air is blown through the paper web during its passage over the TAD cylinder. Paper produced in this way, mainly soft paper, becomes very soft and bulky. The method however is very energy-consuming since all water that is removed has to be evaporated. In connection with the TAD drying the pattern structure of the drying fabric is transferred to the paper web. This structure is essentially maintained also in wet condition of the paper, since it has been imparted to the wet paper web. A description of the TAD technique can be found in e.g. U.S. Pat. No. 3,301,746.

Impulse drying of a paper web is disclosed in e.g. SE-B-423 118 and shortly involves that the moist paper web is passed through the press nip between a press roll and a heated roll, which is heated to such a high temperature that a quick and strong steam generation occurs in the interface between the moist paper web and the heated roll. The heating of the roll is e.g. accomplished by gas burners or other heating devices, e.g. by means of electromagnetic induction. By the fact that the heat transfer to the paper mainly occurs in a press nip an extraordinarily high heat transfer speed is obtained. All water that is removed from the paper web during the impulse drying is not evaporated, but the steam on its way through the paper web carries along water from the pores between the fibers in the paper web. The drying efficiency becomes by this very high.

In EP-A-0 490 655 there is disclosed the production of a paper web, especially soft paper, where the paper simultaneously with impulse drying is given an embossed surface. This embossment is made by pressing a pattern into the paper from one or both sides against a hard holder-on. This gives a compression of the paper and by this a higher density in certain portions just opposite the impressions and a lower density in the intermediate portions.

In the international patent application no. PCT/SE98/02461 there is disclosed a method for producing an impulse dried paper, especially soft paper, having a three-dimensional pattern, said paper having high bulk and softness. The paper is produced according to the method stated in the introduction, at which the counter means against which the paper is pressed in connection with the simultaneous impulse drying and shaping, has a non-rigid surface so that the paper is given a three-dimensional structure having a total thickness greater than the thickness of the unpressed paper web.

THE OBJECT AND MOST IMPORTANT FEATURES OF THE INVENTION

There is however still a need to further improve and adapt the paper quality to special fields of application. The object of the present invention is to provide a method of producing an impulse dried paper having a three-dimensional pattern, e.g. a soft paper intended as toilet paper, kitchen rolls, paper handkerchiefs, table napkins and other wiping material, and where the paper besides a high bulk and a high softness also has a high extensibility. This has according to the invention been provided by the fact that the wet paper web before said press nip is exerted to a creping- or other compacting procedure which foreshortens the length of the paper web.

According to one embodiment of the invention the paper web has in connection with the creping a dry content of no more than 80 weight-%, preferably no more than 70 weight-% and more preferably no more than 60 weight-%:

The counter means against which the paper web is pressed in connection with the simultaneous impulse drying and shaping has preferably a non-rigid surface so that the paper web is given a three-dimensional structure having a total thickness which is greater than the thickness of the unpressed paper web.

The invention further refers to an impulse dried paper having a three-dimensional pattern of alternating raised and recessed portions, which is given the paper in connection with impulse drying, said paper at a tension load in machine direction close to break load has an extensibility corresponding to a lengthening of the paper web of at least 10%, preferably at least 15% and more preferably at least 20%.

Further features and advantages of the invention are disclosed in the following description and in the dependant claims.

BRIEF DESCRIPTION OF THE DRAWINGS

The invention will in the following be closer described with reference to an embodiments shown in the accompanying drawing.

DESCRIPTION OF THE INVENTION

Figure 1:
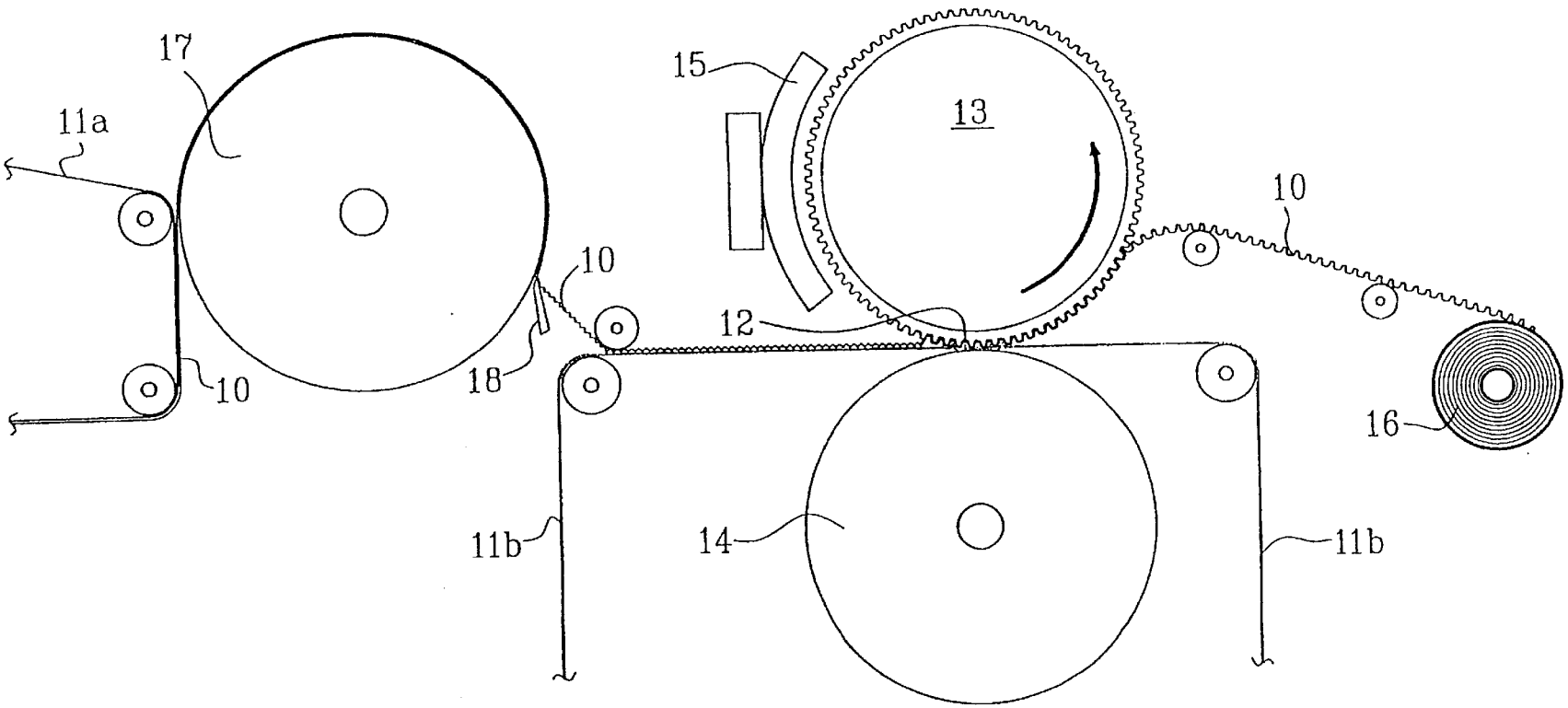
FIG. 1 is a schematic side view of an impulse drying device according to the invention.

FIG. 1 shows schematically a device for producing a paper according to the invention. The wet paper web 10 which is dewatered over suction boxes (not shown), is supported by a wire or felt 11*a* and is led over a so called Yankee cylinder 17, which is heated so that a certain drying of the paper web takes place, however preferably to a dry content of no more than 80 weight-%, preferably no more than 70 weight-% and more preferably no more than 60 weight-%. The paper web is creped from the surface of the Yankee cylinder 17 by a doctor blade 18. This creping is wet creping since the paper web during creping is still wet or at least moist. By the creping a very fine creasing of the paper web takes place.

The type of creping described above may be replaced by any other type of foreshortening of the paper web, such as micro creping, which e.g. is disclosed in U.S. Pat. No. 3,260,778 and U.S. Pat. No. 4,432,92, or though the so called "Clupak"-method, according to which a wet paper web is compacted by being placed on a rubber belt and be exerted to a varying tensile stress.

It would also be possible when transferring the paper web between two different wires e.g. from a dewatering wire to a drying wire, to have a speed difference between the wires so that the paper web is braked at the transfer. The paper web will then be compacted, which increases the extensibility and softness qualities. This is e.g. disclosed in U.S. Pat. No. 5,607,551.

The above described creping- and foreshortening processes may of course be combine with each other.

After creping the paper web 10, which is supported by a wire or felt 11*b*, is brought into a press nip 12 between two rotatable rolls 13 and 14, at which the roll 13 which is in contact with the paper web is by a heating device 15 heated to a temperature which is sufficiently high for providing drying of the paper web. The surface temperature of the heated roll can vary depending on such factors as the moisture content of the paper web, thickness of the paper web, the contact time between the paper web and the roll and the desired moisture content of the completed paper web. The surface temperature should of course not be so high the paper web is damaged. An appropriate temperature should be in the interval 100–400° C., preferably 150–350° C. and most preferably 200–350° C.

The paper web is pressed against the heated roll 13 by means of the roll 14. The press device may of course be designed in many other ways. Two and more press devices may also be arranged after each other. The holder-on 14 may also be a press shoe. It is also possible that the paper web 10 is passed into the press nip unsupported, i.e. not supported by any wire or felt.

A very rapid, violent and almost explosive steam generation takes place in the interface between the heated roll 13 and the moist paper web, at which the generated steam on its way through the paper web carries away water. For a further description of the impulse drying technique reference is made to the above mentioned SE-B-423 118 and e.g. to EP-A-0 337 973 and U.S. Pat. No. 5,556,511.

The paper web 10 can according to an alternative embodiment after said press nip 12 be led around an essential part of the periphery of the heated roll 13 in order to provide an after-drying of the paper web while this is still in contact with three dimensional pattern of the roll 13. By this the paper web will be in contact with the pattern of the roll 13 during the entire drying process, which means that a further stabilization of the pattern structure given the paper in connection with the impulse drying. The paper is after drying wound on a wind-up roll 16.

Simultaneously with the impulse drying the paper is given a three-dimensional structure. This can be made as shown in FIG. 1 by the fact that the heated roll 13 is provided with an embossing pattern consisting of alternating raised and recessed areas. This structure is substantially maintained also in a later wetted condition of the paper, since it has been imparted the wet paper web in connection with drying thereof. Since the term embossing is normally used for a shaping performed on dried paper we have it the following used the term press moulding for the three-dimensional shaping of the paper that occurs simultaneously with the impulse drying. By this press moulding the bulk and absorption capacity of the paper is increased, which are important qualities for soft paper.

The creased structure which is given the wet paper web in connection with the creping is substantially maintained also in the dried paper web. Hereby the extensibility and toughness of the paper in machine direction is essentially increased. Preferably the paper has an extensibility at a tension load in machine direction close to brake load of at least 10%, preferably at least 15% and more preferably at least 20%.

The paper can at the impulse drying be pressed against a non-rigid surface, i.e. a compressible press felt 11*b*. The roll 14 can also have an elastically yielding surface, e.g. an envelope surface of rubber. The paper is herewith given a three-dimensional structure, the total thickness of which is greater than the thickness of the unpressed paper. By this the paper is imparted a high bulk and by that a high absorption capacity and a high softness. Besides the paper will be elastic. At the same time a locally varying density of obtained in the paper.

The paper can also be pressed against a hard surface, e.g. a wire 11*b* and/or a roll 14 having a hard surface, at which the pattern of the heated roll 13 is pressed into the paper web under a heavy compression of the paper opposite the impressions, while the portions therebetween are kept uncompressed.

The pattern structure in the paper can also be made by means of a pattern band or belt (not shown) which extends around and is heated by the roll 13 and is led through the press nip 12 between the roll 13 and the paper web 10.

Alternatively the paper web 10 may during the drying be supported by a wire 11*b* having a pattern, which is press moulded into the paper web when this passes through the press nip 12 between the rolls 13 and 14. The roll 13 can either be smooth or have an embossing pattern. In the case the roll 13 is smooth the press moulded paper will have one smooth surface and one surface with impressions. In the case the roll 13 has an embossing pattern this will also be pressed into the paper, which thus on one side will have a pattern corresponding to the structure of the wire 11*b* and on the opposite side having a pattern corresponding to the embossing pattern of the roll. The patterns may but need not coincide and/or be the same or different.

The paper web 10 can after said press nip 12 be led around an essential part of the periphery of the heated roll 13 in order to provide an after-drying of the paper web while this is still in contact with three dimensional pattern.

Possibly the paper web can after the first press nip and before winding on the wind-up roll 16 be passed through a second press nip (not shown) where a second impulse drying of the paper web takes place. This implies of course that the paper web before the second press nip is not completely dry but has a moisture content of at least 10 and preferably at least 20 weight %. This can be achieved if the drying in the first impulse drying step in the press nip 12 is not complete and/or by moistening the paper web before the second impulse drying step.

Simultaneously with the two impulse drying steps the paper web is given a three-dimensional structure. The patterns can be pressed into the paper web from opposite sides. It is of course also possible to press different patterns into the paper web from the same side. The patterns pressed into the paper web in the two impulse drying steps are preferably different.

According to one embodiment of the invention a material may be added to the paper web, said material softens or melts in the temperature interval 100–400° C. Said material can be synthetic or natural polymers with thermoplastic properties, chemically modified lignin and/or synthetic or natural polymers in the presence of softening agents. The material can either be in the form of powder, flakes, fibers or an aqueous suspension, e.g. a latex dispersion. Examples of thermoplastic polymers are polyolefines such as polyethylene and polypropylene, polyesters etc. The material can either be supplied to the entire paper web or only to the portions thereof that are intended to be located closest to the heated roll 13.

By adding to the paper web said material, which is brought to soften or melt, there is achieved an increased amount of bonding sites in the paper web. By this the basis weight variation and three-dimensional structure, that has been imparted to the paper web in connection with the combined impulse drying and press moulding, is effectively permanented. This structure is maintained also in the wet condition of the paper.

Paper can be produced by a number of different pulp types. If one disregards recovery pulp, which today is used to a great extent mainly for toilet paper and kitchen rolls, the most commonly used pulp type for soft paper is chemical pulp. The lignin content in such pulp is practically zero and the fibers, which mainly consist of pure cellulose, are relatively thin and flexible. Chemical pulp is a low yield pulp since it gives a yield of only about 50% calculated on the wooden raw material used. It is therefore a relatively expensive pulp.

It is therefore common to use cheaper so called high yield pulps, e.g. mechanical, thermomechanical pulp, chemomechanical pulp (CMP) or chemothermomechanical pulp (CTMP) in soft paper as well as in other types of paper, e.g. newsprint paper, cardboard etc. In high yield pulps the fibers are coarser and contain a high amount of lignin, resins and hemicellulose. The lignin and the resins gives the fibers more hydrophobic properties and a reduced ability to form hydrogen bonds. The addition of a certain amount of chemothermomechanical pulp in soft paper has due to the reduced fiber-fiber bonding a positive effect on properties like bulk and absorption capacity.

A special variant of chemothermomechanical pulp (CTMP) is so called high temperature chemothermomechanical pulp (HT-CTMP), the production of which differs from the production of CTMP of conventional type mainly by using a higher temperature for impregnation, preheating and refining, preferably no lower than 140° C. For a more detailed description of the production method for HT-CTMP reference is made to WO 95/34711. Characterizing for HT-CTMP is that it is a long fibrous-, easily dewatered- and bulky high yield pulp with a low shives content and low fines content.

It has according to the invention been found that high yield pulp is especially suitable for impulse drying since it is pressure insensitive, easily dewatered and has an open structure which admits the generated steam to pass through. This minimizes the risk for the paper to be overheated and destroyed during the impulse drying, which is performed at considerably higher temperatures than in other drying methods. The pressure insensitivity and the open structure depends on that the fibers in high yield pulp are relatively coarse and stiff as compared to the fibers in chemical pulp.

A further advantage is that the three-dimensional pattern and the creping structure given the paper is essentially maintained also in wet condition of the paper, since it is imparted to wet the wet paper web in connection with the drying thereof. Impulse drying further takes place at a considerably higher temperature than e.g. Yankee drying or through-air-drying, at which according to a theory, to which however the invention is not bound, the softening temperature of the lignin present in the high yield pulp is reached during the simultaneous impulse drying and press moulding. When the paper becomes cooler the lignin stiffens again and contributes in permanenting the three-dimensional structure that has been given the paper. This is therefore essentially maintained also in the wet condition of the paper, which strongly improves the bulk and absorption qualities of the paper.

According to one embodiment oft he invention the paper contains a certain amount of a high yield pulp, said amount should be at least 10 weight % calculated on the dry fiber weight, preferably at least 30 weight % and more preferably at least 50 weight %. Admixture of a certain amount of another pulp with high strength properties, such as chemical pulp, preferably long-fibrous kraft pulp, or recycled pulp, is an advantage if a high strength of the paper is aimed at. The invention is however not bound to the use of a certain type of pulp in the paper, but can be applied with any optional pulp type or mixture of pulp types.

According to a further embodiment of the invention the paper web 10 can in connection with forming and dewatering be given a variation in basis weight in a non-random pattern. This can for example be provided by forming and dewatering the paper web on a wire, belt or band the dewatering capacity of which varies according to a certain pattern and where the differences in dewatering capacity involves a certain displacement of fibers and by that a local change of the basis weight of the paper web.

The basis weight variation that is given the paper web 10 in connection with forming and dewatering is permanented in the subsequent impulse drying step, at which the structure is essentially maintained also in the wet condition of the paper.

According to a further embodiment of the invention the paper web has a varying material composition as seen in its thickness direction, in such a way that it at least in the layer(s) that will be located closest to heated roll 13 in connection with the impulse drying contains a certain amount of a material which softens, melts or hardens in the temperature interval 100–400° C. By this the paper will get a surface layer which contributes in reinforcing the structural stability of the paper also in wet condition. The pulp composition in the rest of the paper layers can on the other hand be chosen for optimizing other properties such as softness, strength, bulk and draping qualities.

Said material which in connection with impulse drying softens, melts or hardens can consist of a wet strength agent, synthetic or natural polymers with thermoplastic properties, chemically modified lignin and/or synthetic or natural polymers in the presence of softening agents or of a lignin-containing high yield pulp.

Common additives such as wet strength agents, softening agents, fillers etc. may of course also be used in the paper. The paper web can after impulse drying undergo different types of per se known treatments such as addition of different chemicals, further embossing, lamination etc.

What is claimed is:

1. Method of producing a paper having a three-dimensional pattern of alternating raised and recessed portions by impulse drying, comprising the steps of:

passing a wet paper web through at least one press nip having a rotatable heated roll; and pressing a three-dimensional pattern of alternating raised and recessed portions into the wet paper web by impulse drying, during passage through the at least one press nip, using one of a patterned wire, band or belt and a pattern on the heated roil, said pattern being pressed into the paper web against a counter means, wherein the wet paper web before said press nip is exerted to a compacting procedure which foreshortens the length of the wet paper web.

2. Method as claimed in claim 1, wherein the wet paper web in connection with the compacting procedure has a dry content of no more than 80% by weight.

3. Method as claimed in claim 1, characterized in that the counter means (11, 14) is provided with a non-rigid surface so that the paper web is given a three dimensional structure having a total thickness greater than the thickness of the unpressed paper web.

4. Method as claimed in claim 3, characterized in that the paper web is supported by a compressible press felt (11) through the press nip (12), said press felt makes said non-rigid counter means.

5. Method as claimed in claim 4, characterized in that the press felt (11) is pressed against a resilient surface (14) in the press nip (12).

6. Method as claimed in claim 1, wherein the compacting procedure has a dry content of no more than 70% by weight.

7. Method as claimed in claim 1, wherein the compacting procedure has a dry content of no more than 60% by weight.

* * * * *